United States Patent [19]

Furutsu

[11] Patent Number: 4,485,954

[45] Date of Patent: Dec. 4, 1984

[54] TAG ASSEMBLY FEEDING MECHANISM

[75] Inventor: Akira Furutsu, Tokyo, Japan

[73] Assignees: Japan Bano'k Co., Ltd., Tokyo, Japan; Ben Clements & Sons, Inc., South Hackensack, N.J.

[21] Appl. No.: 384,117

[22] Filed: Jun. 1, 1982

[51] Int. Cl.[3] ..... B25C 1/00

[52] U.S. Cl. ..... 227/67; 198/750

[58] Field of Search ..... 227/67; 226/127-128, 226/134, 165-166, 67-68, 120-121; 198/750, 772, 859

[56] References Cited

U.S. PATENT DOCUMENTS 3,924,788 12/1975 Furutsu ..... 227/67

*Primary Examiner*—E. R. Kazenske
*Assistant Examiner*—Douglas D. Watts
*Attorney, Agent, or Firm*—Blum, Kaplan, Friedman, Silberman & Beran

[57] ABSTRACT

A tag attacher in which pulling a trigger causes a cam plate to be lifted against spring force and a linked cutting edge to be stuck into a connecting bar of a tag pin assembly at the same time that one of the tag pins of the tag pin assembly that is loaded in the tag attacher is driven through a hollow needle; and in which when the trigger is released the spring force lowers the cam plate causing the cutting edge stuck into the connecting bar of the tag pin assembly to pull down the connecting bar so as to guide the crossbar of a next located tag pin to the inlet of the hollow needle. With this tag attacher, it is possible to successively drive tag pins into merchandise if the tag pin assemblies used have different inter-pin pitches. Furthermore, since the connecting bar that has been removed of tag pins and fed out of the tag attacher has notches, it can easily be torn off by hand.

5 Claims, 7 Drawing Figures

TAG ASSEMBLY FEEDING MECHANISM

BACKGROUND OF THE INVENTION

The present application is related to applicant's copending U.S. patent application Ser. Nos. 06/326,953 filed Dec. 2, 1981 and 06/329,090 filed Dec. 9, 1981, both of which are also directed to improved tag pin assembly feeders for use in tag attachers.

This invention relates to a tag attacher, and more particularly, to a tag attacher which is capable of driving tag pins one by one accurately irrespective of the inter-pin pitch of a tag pin assembly and in which the pin connecting bar can be easily removed after tag pins are dispensed.

In attaching tags to merchandise or connecting two or more articles together, tag pins have conventionally been used.

The tag pin is formed of plastics and consists of a filament having a head at one end and a crossbar at the other end. A number of tag pins are attached to one connecting bar through connecting necks to form a tag pin assembly. One tag pin assembly has about 20 to 50 individual tag pins with the inter-pin pitch set at about 2 mm.

With a tag pin assembly loaded into a tag attaching apparatus and with a hollow needle at the front end of the tag attacher pierced through a label and an article, the lever (or trigger) of the tag attacher is pulled driving one tag pin through the hollow needle into the label and the article. Then the label and the article are held between the head and crossbar of the tag pin so that the tag pin cannot be pulled off.

This invention relates to a device for dispensing tag pins one at a time. The conventional tag attachers employ a gear as means to feed tag pins to a rear portion of the hollow needle by engaging teeth of the gear between the tag pins and pulling lever to rotate the gear. Therefore, the pitch of the gear teeth is made to match the pitch of tag pins. However, this kind of tag attachers using gear as tag pin feeding means cannot be used with tag pin assemblies having different inter-pin pitches.

SUMMARY OF THE INVENTION

An object of this invention is to provide a tag attacher which can drive tag pins accurately one at a time irrespective of the inter-pin pitch of the tag pin assembly.

Another object of this invention is to provide a tag attacher in which the pin connecting bar, after some or all of the pins formed thereon have been dispensed, can easily be removed by hand from the tag attacher.

To achieve the above objects, the tag attacher of the present invention comprises: a cam plate provided at the side of a guide groove for a connecting bar of a tag pin assembly loaded into the tag attacher, the tag pin assembly consisting of a plurality of tag pins arranged in line on the connecting bar, each of the tag pins being formed of a head, a filament and a crossbar, the cam plate being lifted when the trigger is pulled and lowered by a spring force when the trigger is released; and a feed lever pivotably mounted to the cam plate and having a cutting edge, the feed lever being lifted together with the cam plate when the trigger is pulled, the cutting edge of the feed lever being stuck into the connecting bar of the tag pin assembly as the trigger is further pulled to its extreme end of the stroke, the feed lever being lowered together with the cam plate when the tag pin driving process is completed and the trigger is released with the result that the lowering cutting edge stuck into the connecting bar pulls it down; whereby the tag pin is thrust into the grooved hollow needle by a push rod by operating the trigger so as to attach a price tag to merchandise.

DETAILED DESCRIPTION OF THE INVENTION

Figure 1:
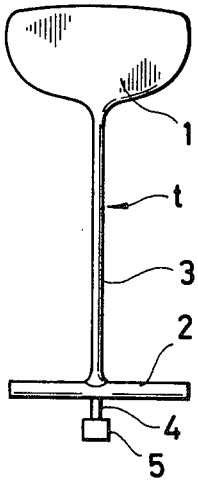
FIG.1 PRIOR ART
FIG. 1 is a front elevational view showing an example of tag pin assemblies.
Figure 2:
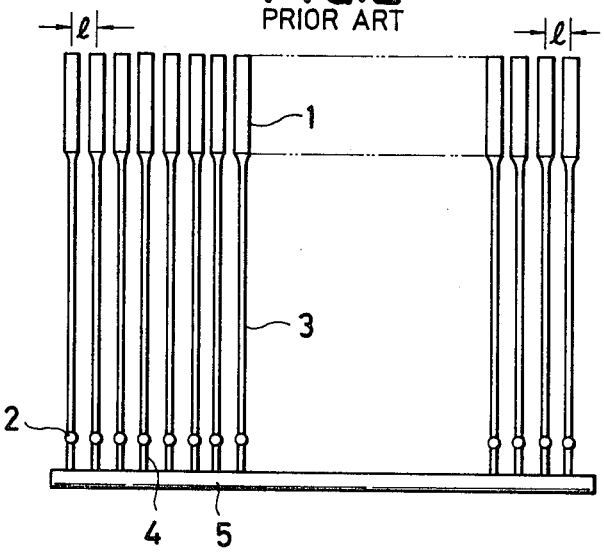
FIG.2 PRIOR ART
FIG. 2 is a side view of the tag pin assembly as shown in FIG. 1.

The tag pin t consists of head 1 to which a price tag or the like is attached, a filament 3 and a crossbar 2 that pierces through articles such as clothes, as shown in FIGS. 1 and 2. A plurality of these tag pins t are formed in line on a connecting bar 5 via connecting necks 4 like comb teeth to form a tag pin assembly T which is formed as one piece of a synthetic resin such as nylon and polypropylene. Tag pins are produced in the form of this tag pin assembly T because of a higher productivity and an easy handling during packing, transportation and operation, which are then obtainable, and each connecting bar 5 has about 20 to 50 tag pins t. For reasons of ease in preparing molds and also in the loading of the tag pin assembly T into the tag attacher, the interval l between tag pins t arranged on the connecting bar 5 is set at about 2 mm.

Figure 3:
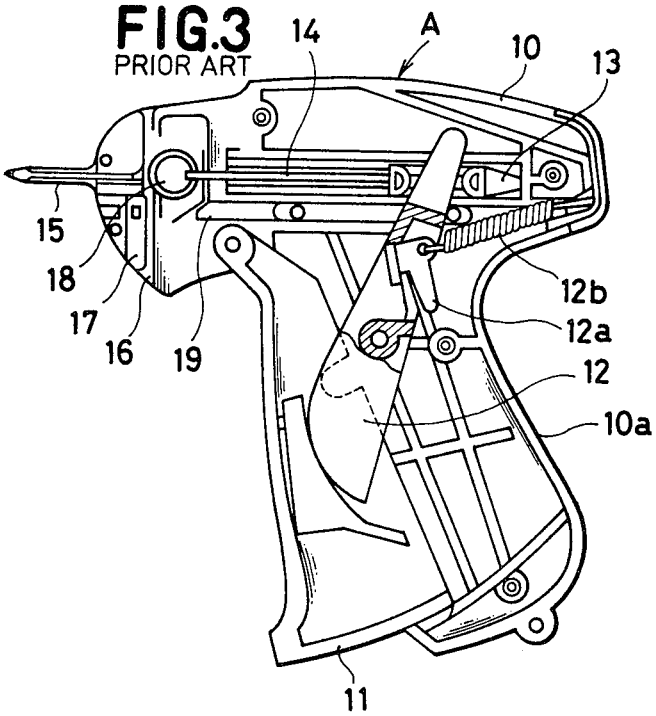
FIG.3 PRIOR ART
FIG. 3 is a cross-sectional side view of a conventional tag attacher.

In the conventional tag attacher A shown in FIG. 3, a trigger 11 is pivotably provided at the grip 10*a* of a body 10. The movement of the trigger 11 is transmitted to an intermediate lever 12 and a slider 13 to move a push rod 14 toward a grooved hollow needle 15 thus thrusting one tag pin t positioned at the rear of the hollow needle 15 into the needle 15 and sending it to the back side of the clothing through which the hollow needle 15 pierces. In this way a price tag or the like is secured to the clothes by the tag pin t. At the front portion, the tag attacher A is formed with a guide groove 16 into which the connecting bar 5 of the tag pin assembly T is inserted downward. As the crossbar 2 of the tag pin t is moved through the hollow needle 15, the connecting neck 4 is cut off by a cutter 17.

Figure 4:
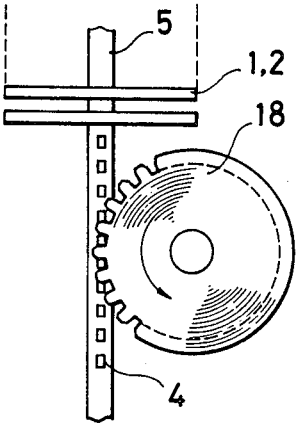
FIG.4 PRIOR ART
FIG. 4 is a front view of a feeding mechanism of the conventional tag attacher.

In the conventional tag attacher A, as shown in FIG. 4 a gear 18 is used as a tag-pin feeder means, and its teeth are put in mesh with the connecting necks 4 projecting from the connecting bar 5 so that the operator's gripping action on the trigger 11 moves a slide bar 19, which in turn drives the claw of a ratchet by a cam mechanism (not shown) to intermittently rotate the gear 18 by one tooth for each trigger operation thereby feeding the tag pins.

As described earlier, the interval l between the tag pins t arranged on the connecting bar 5 is about 2 mm and therefore the connecting necks are also spaced about 2 mm from one another.

The intervals l between tag pins t arranged on the connecting bar 5 are thus set at a certain length for reasons described earlier. In recent years, however, there is a growing demand for producing tag pin assemblies having different inter-pin pitches. Further, it is advantageous from the viewpoint of thermal economy to make the mold smaller and thereby reduce the thermal capacity. This also reduces the cost of preparation of molds.

For tag pin assemblies T having a very long filament portion, further, it is necessary to further increase the intervals l between tag pins t.

Where the distance between the connecting necks 4 varies, a difficulty arises with the conventional tag attacher. That is, in the conventional tag attacher, as shown in FIG. 4 the gear 18 is meshed with the connecting necks 4, and the pitch of the connecting necks 4 must therefore be equal to that of the gear teeth. Thus the tag pin assemblies T that can be effectively fed by the conventional tag attacher are only those which have the connecting-neck pitch of about 2 mm. Tag pin assemblies T having pitches other than 2 mm cannot be fed by the conventional tag attachers.

There is another problem with the conventional tag attachers. That is, each time the tag pin t is cut off, the connecting bar 5 is fed downward coming out of the lower opening of the guide groove 16 into which the connecting bar 5 has been inserted. The roots of the connecting necks 4, however, remain protruded from the connecting bar 5 and easily get caught on clothes or the like. Therefore, the operator must cut the downwardly protruding connecting bar 5 by a cutter or scissors when the connecting bar is fed out and protrudes a certain length from the lower end of the guide groove.

Figure 5:
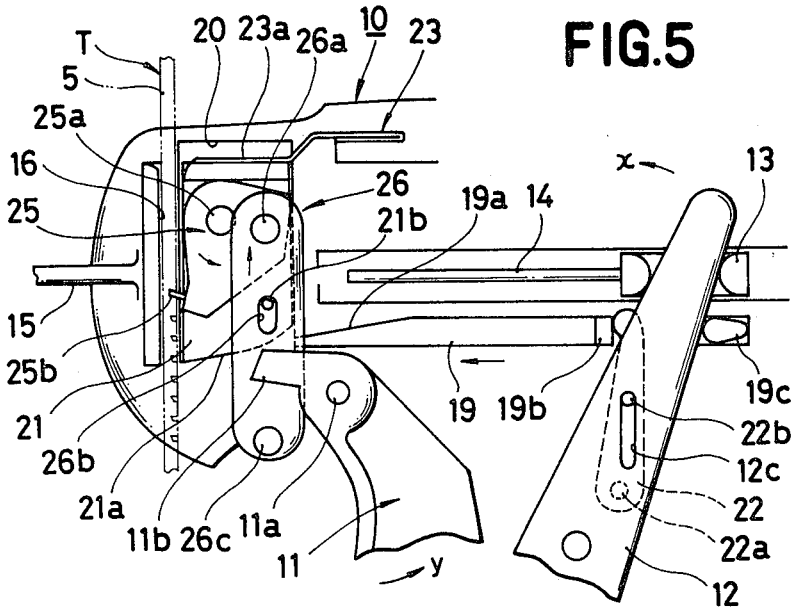
FIGS. 5 through 7 are front views, showing the feeding mechanism of the tag attacher according to the present invention.

FIG. 5 shows a front view showing an essential portion of the tag attacher of this invention.

In a front portion, the body 10 is formed with a guide groove 16 into which the connecting bar 5 of a tag pin assembly T is inserted. At the side of the guide groove 16 there is formed a recess 20 in which a cam plate 21 is disposed vertically slidable. The cam plate 21 has an inclined guide surface 21*a* on the underside with which a slant contacting portion 19*a* at the front end of the slide bar 19 is adapted to come into contact. The slide bar 19 has a projection 19*b* at the rear portion with which an auxiliary intermediate lever 22 linked with the intermediate lever 12 comes into contact when the intermediate lever 12 is rotated in the direction of an arrow x of FIG. 5, thereby advancing the slide bar 19 lifting the cam plate 21 by the slant contacting portion 19*a* of the slide bar 19.

Above the cam plate 21 there is positioned a free end portion 23*a* of an elastic member 23 of phosphorus bronze formed stepwise. As the cam plate 21 is lifted, the free end portion 23*a* of the elastic member 23 is pushed up storing an elastic energy that urges the cam plate 21 to move down.

The cam plate 21 also has a feed lever 25 pivotably supported on a shaft 25*a*. To the side of the feed lever 25 facing the connecting bar 5 inserted in the guide groove 16 there is provided a projecting cutting edge 25*b* which cuts into the connecting bar 5, forming a deep notch therein. The upper end of a link 26 for oscillating the feed lever 25 is mounted by a shaft 26*a* to the feeding lever 25. At a middle portion of the link 26 is formed a slit 26*b* in which a pin 21*b* projecting from the cam plate 21 is fitted so that as the cam plate 21 is lifted the link 26 is also pushed upward by the pin 21*b*, thereby rotating the feed lever 25 about the shaft 25*a* in such a direction as to move away from the connecting bar 5. The link 26 has a pin 26*c* projecting from the lower end thereof. When the trigger 11 is gripped, i.e., when the trigger 11 is turned about a shaft 11*a* in the direction of arrow y of FIG. 5, a pressing member 11*b* formed at the upper end of the trigger 11 is pressed against the pin 26*c* pushing down the link 26, with the result that the feed lever 25 is rotated about the shaft 25*a* in such a direction as to approach the connecting bar 5.

The auxiliary intermediate lever 22 is pivotably mounted to the body 10 by a shaft 22*a* and has a pin 22*b* projecting at an intermediate point which is fitted into the slit 12*c* cut in the intermediate lever 12 so as to turn with the rotation of the intermediate lever 12.

Figure 7:
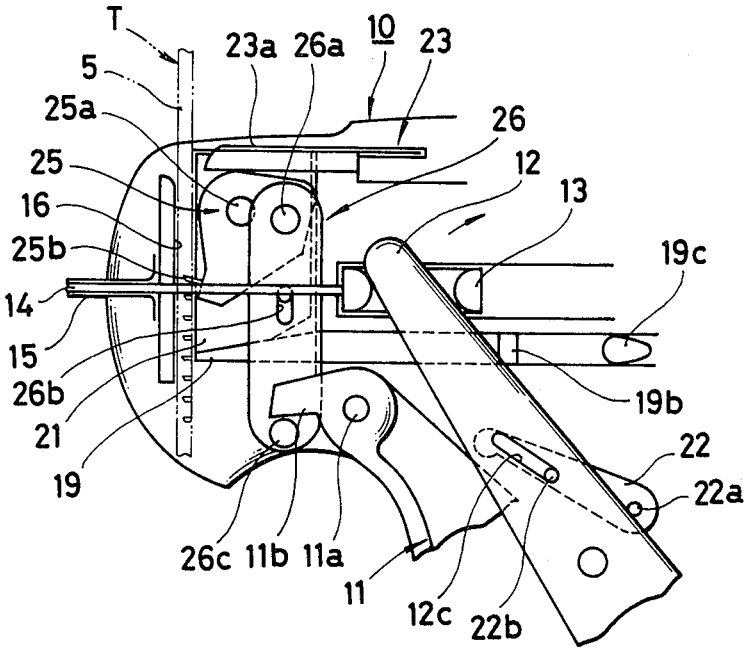

Next, the operation of the tag attacher of this invention is explained by the following. FIG. 7 shows the condition of the tag attacher in which one of the tag pins t has been separated from the tag pin assembly T and driven into an article by gripping operation of the trigger 11. In this condition the cam plate 21 is pushed up to the uppermost position and the pressing member 11*b* of the trigger 11 presses the pin 26*c* pushing down the link 26. The feed lever 25 is turned toward the connecting bar 5 about the shaft 25*a* with the cutting edge 25*b* sticking into its connecting bar 5. Then if the grip on the trigger 11 is loosened, the trigger 11 returns to the home position as shown in FIG. 5 causing the intermediate lever 12 to abut against the projection 19*c* of the slide bar 19 thus retracting the slide bar 19, with the result that the cam plate 21 is lowered by the resilient force of the elastic member 23. At this time, since the cutting edge 25*b* of the feed lever 25 remains stuck in the connecting bar 5, the connecting bar 5 is forced down by the lowering feed lever 25 which moves down along with the cam plate 21. Though not shown in detail, near the inlet of the hollow needle 15 there is provided a stopper to support the crossbar 2 of the tag pin t in position so that when the next tag pin t is lowered by the feed lever 25 to the position closest to the inlet of the hollow needle 15, the feed lever 25, cam plate 21, link 26 and the tag pin assembly are stopped at the positions as shown in FIG. 5.

When the trigger 11 is gripped again, it is rotated about the pin 11*a* in the direction of the arrow y of FIG. 5, causing the intermediate lever 12 to turn in the direction of arrow x. As a result, the slider 13 is advanced by the intermediate lever 12 and at the same time the slide bar 19 is also advanced by the auxiliary intermediate lever 22. As the advancing slide bar 19 lifts the cam plate 21, the link 26 is forced up by the pin 21*b*, thus turning the feed lever 25 about the shaft 25*a* in a direction such that the cutting edge 25*b* is drawn out of the connecting bar 5. Therefore, when the feed lever 25 is lifted with the upward movement of the cam plate 21, the cutting edge 25*b* comes off the connecting bar 5 and thus there is no possibility of the cutting edge 25*b* catching the connecting bar 5 when being lifted.

Figure 6:
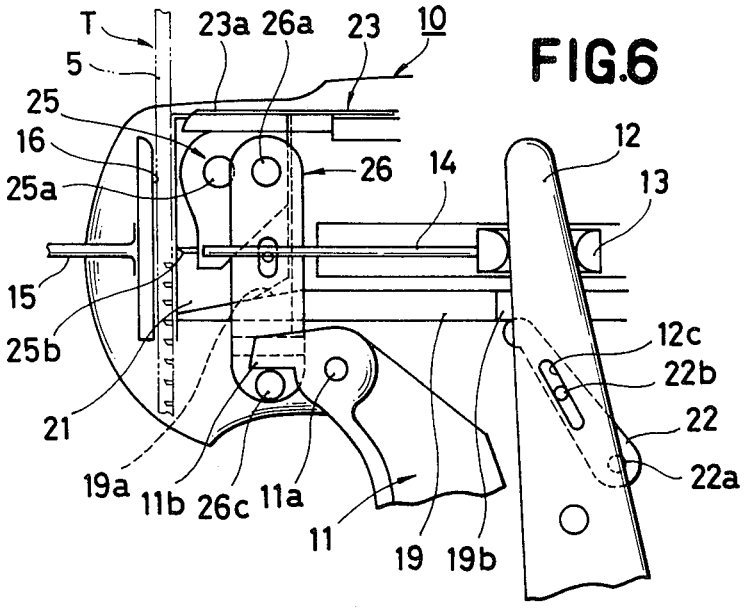

Then from the condition shown in FIG. 6, the push rod 14 is advanced into the hollow needle 15 thrusting into it the crossbar 2 of the tag pin t positioned at the inlet of the needle 15. At this time the auxiliary intermediate lever 22 has already been disengaged from the projection 19*b* of the slide bar 19, so that the slide bar 19 does not advance any further, and the cam plate 21 stays at the uppermost position pushing up the free end 23*a* of the elastic member 23.

As the trigger 11 is pulled and approaches its extreme end of the stroke, the push rod 14 sends the crossbar 2 of the tag pin t to the back side of the clothing through which the hollow needle 15 passes. At the same time the pressing member 11*b* of the trigger 11 comes into contact with the pin 26*c*, pushing down the link 26. This causes the feed lever 25 to pivot on the shaft 25*a* toward the connecting bar 5 sticking the cutting edge 25*b* into the connecting bar 5. The force with which the cutting edge is stuck into the connecting bar 5 is the gripping force on the trigger 11. Therefore the cutter is reliably stuck into the connecting bar 5 and the notch can easily be formed in the bar. And then the connecting bar is pulled down in a manner as described in the preceding process.

As the above operation is repeated, the connecting bar 5 with the tag pins t cut off is successively fed out of the lower opening of the guide groove 16. Since the connecting bar 5 has notches at appropriate intervals formed by the cutting edge 25*b*, it can be easily torn off when it protrudes by a certain length.

In the above embodiment, description is made in connection with the case where the slide bar 19 is advanced by the auxiliary intermediate lever 22 to lift the cam plate 21. It alternatively is possible to omit the auxiliary intermediate lever 22 and directly advance the slide bar 19 by the intermediate lever 12 to lift the cam plate 21, by providing an appropriate engagement relationship between the contact portion 19*a* of the slide bar 19 and the guide surface 21*a* of the cam plate 21.

The mechanism of the tag attacher of this invention may be summarized as follows: The cam plate 21 supporting the feed lever 25 is lifted by the intermediate lever 12; with the cam plate 21 lifted, the feed lever 25 is rotated by the gripping force on the trigger 11 to stick the cutting edge 25*b* into the connecting bar 5; and then as the grip on the lever 11 is released, the resilient member 23 causes the feed lever 25 to move down along with the cam plate 21, lowering the connecting bar 5. Because of this construction, tag pins can be fed to the drive position irrespective of a change in the pitch of tag pins.

With the tag attacher of this invention, if the tag attacher is sized so that the cam plate 21 is given a vertical stroke somewhat greater than the pitch of tag pins, the extra movement is absorbed by the elastic member, thus making it possible to use tag pin assemblies of different inter-pin pitches.

This invention has a further advantage that each time the connecting bar is pulled down, the connecting bar is formed with a notch by a cutting edge so that the connecting bar protruding from the lower end of the guide groove can easily be torn off by hand at any time without having to use scissors or a cutter and without interrupting the tag attaching operation. Furthermore, the cutting edge is stuck into the connecting bar by the gripping force on the trigger, and therefore the sticking of the cutter can be done reliably to form notches in the connecting bar.

What is claimed is:

1. A tag attacher for dispensing tag pins from a tag assembly, each said tag pin including a head and a crossbar joined together by a filament, said tag pins being removably coupled to a connecting bar in sequence to form said tag assembly, comprising a body having a front end, a trigger pivotally coupled to said body, a grooved hollow needle removably secured in said front end of said body, said trigger being pivotally operable to drive a crossbar of a tag pin into said hollow needle, said body including a guide groove in said front end which receives and guides a connecting bar of a tag pin assembly, a cam plate disposed adjacent said guide groove, said cam plate being lifted to an upper position along said guide groove when said trigger is operated and lowered to a lower position when said trigger is released, a feed lever pivotably mounted on said cam plate and having a cutting edge projecting towards said guide groove, a link having an upper portion pivotally coupled to said feed lever, and a pressing member coupled to said trigger adapted to engage with said link, said feed lever and link being lifted together to said upper position with said cam plate when said trigger is operated, said pressing member being moved into contact with said link, said link pivoting said feed lever so that the cutting edge of the feed lever is pressed into the connecting bar of the tag pin assembly, the feed lever being lowered together with the cam plate when said trigger is released to pull the connecting bar down so that the next tag pin in said assembly is moved into alignment with said grooved hollow needle for dispensing with the next operation of said trigger.

2. A tag attacher as defined in claim 1, further comprising a slide bar having an inclined face which engages said cam plate which is slid hoizontally by the operation of the trigger to lift the cam plate.

3. A tag attacher as defined in claim 2, further comprising a push rod for pushing tag attachments through said hollow needle, wherein the trigger is linked with an intermediate lever and an auxiliary intermediate lever so that slide the push rod horizontally and the auxiliary intermediate lever to slide said slide bar horizontally.

4. A tag attacher as defined in claim 3, wherein the push rod is located at the rear end of the hollow needle so that when the trigger is pulled the crossbar of the lowermost tag pin of the tag pin assembly is thrust into the hollow needle.

5. A tag attacher as defined in claim 1, wherein the connecting bar which has been removed of tag pins and fed out of the tag attacher is formed with notches by the cutting edge so that it can easily be torn off by hand.

* * * * *